United States Patent [19]

Tabuchi

[11] 4,447,518

[45] May 8, 1984

[54] ELECTROSTATIC IMAGE DEVELOPING METHOD CORRECTING IRREGULARITIES OF MAGNETIC BRUSH DEVELOPING

[75] Inventor: Kenji Tabuchi, Toyokawa, Japan

[73] Assignee: Minolta Camera Kabushiki Kaisha, Osaka, Japan

[21] Appl. No.: 460,044

[22] Filed: Jan. 21, 1983

[30] Foreign Application Priority Data

Feb. 5, 1982 [JP] Japan ..... 57-17761
Mar. 18, 1982 [JP] Japan ..... 57-43957

[51] Int. Cl.[3] ..... G03G 13/09
[52] U.S. Cl. ..... 430/122; 118/657
[58] Field of Search ..... 430/122; 118/657

[56] References Cited

U.S. PATENT DOCUMENTS

| | | | |
|---|---|---|---|
| 3,882,821 | 5/1975 | Katayama et al. | 355/3 DD X |
| 4,098,228 | 7/1978 | Ruckdeschel et al. | 430/122 X |
| 4,266,868 | 5/1981 | Bresina et al. | 355/3 DD |
| 4,279,942 | 7/1981 | Swapceinski | 430/122 X |
| 4,299,901 | 11/1981 | Huggins | 430/122 |

FOREIGN PATENT DOCUMENTS

| | | | |
|---|---|---|---|
| 40-17228 | 5/1965 | Japan | 118/657 |

OTHER PUBLICATIONS

"Magnetic Brush Development Apparatus for High-Speed Copiers", Res. Discl. 22421, Dec. 1982, p. 387.

*Primary Examiner*—Roland E. Martin, Jr.
*Attorney, Agent, or Firm*—Wenderoth, Lind & Ponack

[57] ABSTRACT

A method for developing by a plurality of times, an electrostatic latent image carried on a surface of an electrostatic latent image support member through employment of developing sleeves having magnetic rollers to be driven for rotation provided therein, which includes the steps of effecting the developing for each of the plurality of times, with the magnetic roller being rotated under such a state that developing irregularities in a direction intersecting a relative moving direction of the electrostatic latent image support member with respect to the developing sleeve, are formed in a developed image when the developing for each of the plurality of times is effected independently, causing pitches of the developing irregularities to coincide with each other, and deviating phases of the respective developing irregularities so that the respective developing irregularities are offset to each other so as to obtain the developed image having a uniform and sufficient image density without developing irregularities.

11 Claims, 7 Drawing Figures

ELECTROSTATIC IMAGE DEVELOPING METHOD CORRECTING IRREGULARITIES OF MAGNETIC BRUSH DEVELOPING

BACKGROUND OF THE INVENTION

The present invention generally relates to electrography and more particularly, to a method of developing electrostatic latent images carried on the surface of an electrostatic latent image support member, through employment of developing sleeves having magnetic rollers rotatably accommodated therein.

As one form of the developing apparatus for effecting the developing method as referred to above, there has been conventionally proposed an arrangement, as shown in FIG. 1, in which a magnetic developing material De composed of a mixture of magnetic carrier and electrically insulative toner is supplied onto the peripheral surface of a developing sleeve S, while a magnetic roller M provided within the developing sleeve S is driven for rotation in a direction indicated by an arrow m so as to transport the developing material De in the direction of an arrow t along the peripheral surface of the developing sleeve S for rubbing a photoconductive surface Pa of a photosensitive or photoreceptor drum P being driven for rotation in a direction of an arrow a, by the developing material De thus transported, thereby to develop the electrostatic latent image carried on the surface Pa of the photoreceptor drum P into a visible image.

In the developing apparatus as described above, it has been experienced that, in the case where the number of revolutions of the magnetic roller M is set at a small value, the frequency of an alternating magnetic field to be formed in a developing region is also lowered to a small value, and the developing itself of the electrostatic latent image is heavily affected by the alternating magnetic field, thus resulting in a periodic developing irregularities or uneven developing as shown in FIG. 2, which schematically illustrates a developed image as obtained by developing a solid state electrostatic latent image under a state where the number of revolutions of the magnetic roller M is set at a small value, and in which the arrow a indicates the direction of movement of the photoreceptor drum P with respect to the developing apparatus.

In connection with the above, it has been ensured by the present inventor that the frequency Fmg of the alternating magnetic field may be represented by a following equation $$Fmg = Nmg \cdot Rmg/60 \quad (1)$$

where Nmg is the number of poles of the magnetic roller and Rmg represents the number of revolutions (r.p.m.) of the magnetic roller, while a pitch w of the developing irregularities, i.e. the distance between respective dark and light portions in the developed image as shown in FIG. 2 coincides with the value represented by an equation given below $$w = Vpc/Fmg \quad (2)$$

where w is the pitch (mm) of the developing irregularities and Vpc represents a circumferential speed (mm/sec.) of the photoreceptor drum P.

Meanwhile, upon investigation into formation of developing irregularities through variations of the circumferential speed of the photoreceptor drum P and the number of revolutions of the magnetic roller M in various ways, it has been noticed that the developing irregularities tend to take place in a region below a straight line shown in a graph of FIG. 3, while the formation of such developing irregularities is not noticed in a region above the straight line.

In the above experiment, the developing sleeve S having a diameter of 31 mm was driven for rotation at 25 r.p.m. at all times in the direction indicated by the arrow d in FIG. 1, with the number of poles of the magnetic roller M being set to be eight poles. However, since the amount of the developing material De transported towards a developing region is altered, upon variations of the diameter or number of revolutions, etc. of the developing sleeve S, above the region at which the actual developing irregularities become conspicuous, is consequently altered.

As is seen from the graph in FIG. 3, it is possible to prevent formation of developing irregularities by setting the number of revolutions of the magnetic roller M at a sufficiently large valve, and with respect to the developing apparatus of this kind, high speed driving of the magnetic roller M is required for obtaining a uniform developed image without developing irregularities. Meanwhile, the tendency to form developing irregularities is strengthened, directly depending on the increase of circumferential speed of the photoreceptor drum P.

Therefore, in the case where the circumferential speed of the photoreceptor drum P is increased for a higher copying speed in an electrographic copying apparatus incorporated with the developing apparatus as described above, it is required to increase the rotational speed of the magnetic roller M also by taking into account, the formation of developing irregularities as stated above. By way of example, as is clear from the graph of FIG. 3, in the case where the circumferential speed of the photoreceptor drum P is set at 200 mm/sec. the number of revolutions of the magnetic roller M in the order of 1000 r.p.m or thereabout is sufficient for preventing formation of the developing irregularities, while upon increase of the circumferential speed of the drum P up to 300 mm/sec., the number of revolutions of the magnetic roller M should be at least higher than 1600 r.p.m.

On the other hand, with respect to the developing apparatus as described so far, generation of various inconveniences or troubles following high speed driving of the magnetic roller M has also been experienced. More specifically, as the magnetic roller M is driven for rotation at high speeds, there has been experienced generation of inconveniences due to heat radiation and eddy current loss in which energy is lost in the form of heat through production of a large amount of eddy current in the developing sleeve S, electrically conductive members located in the vicinity thereof or in the electrically conductive layer Pa of the photoreceptor drum P, or generation of inconveniences in which the developing apparatus is subjected to slight vibrations arising from a large torque applied thereto during the high speed driving of the magnetic roller M. The degree of generation of such inconveniences as described above tends to be cumulatively increased as the number of revolutions of the magnetic roller M is raised, and therefore, with respect to the developing apparatus as described so far, while the high speed driving of the magnetic roller M is required for the prevention of generation of the developing irregularities, reduction in the driving speed of the magnetic roller M is simultaneously required as a requirement contrary to the above.

Such being the case, in balancing one requirement with the other as referred to above, the developing apparatus described so far is not suited to the development of electrostatic latent images carried on the surface of the electrostatic latent image support member which is being driven at high speeds, while, in order to obtain a uniform developed image without developing irregularities, generation of the inconveniences as described earlier must be admitted to a certain extent under the present situation.

Furthermore, with respect to the developing material recently proposed by the present inventor, i.e. the developing material composed of a mixture of electrically insulative toner having average particle diameter of 5 to 20 μm and high resistance magnetic carrier prepared by dispersing magnetic fine particles into the resin so as to have average particle diameter of 15 to 60 μm and resistance value of $10^{12}$ Ωcm in the case of developing electrostatic latent images through employment of the developing apparatus as described so far, high speed rotation of the magnetic roller M is required for obtaining developed images at high image density.

Therefore, for developing the electrostatic latent images through employment of the developing material as described above, the problems referred to earlier may also be brought about in association with the achievement of developed images having a sufficient image density, apart from the high speed driving of the electrostatic latent image support member.

SUMMARY OF THE INVENTION

Accordingly, an essential object of the present invention is to provide an improved method of developing electrostatic latent images which is capable of obtaining uniform developed images without any developing irregularities or unevenness, irrespective of low speed driving of the magnetic roller, and which is also suitable for developing electrostatic latent images carried on the surface of an electrostatic latent image support member which is being moved at high speeds.

Another important object of the present invention is to provide an improved electrostatic latent image developing method as described above which makes it possible to obtain developed images with a sufficient image density in the state where the generation of problems as described earlier is reduced, when the electrostatic latent image is to be developed through employment of the developing material proposed by the present inventor as referred to earlier.

The main points of the present invention reside in that, in the electrostatic latent image developing method according to the present invention, the electrostatic latent image is developed by a plurality of times, and that, in the case where each of the developing is to be effected independently, such developing for each time is carried out while the magnetic roller is being rotated under the state where the developing irregularities in a direction intersecting the relative moving direction of the electrostatic latent image support member with respect to the developing sleeve, are formed in the developed image, and in addition, that pitches of the periodic developing irregularities taking place at respective time of the developing are caused to coincide with each other, with phases thereof being deviated from each other. In the electrostatic latent image developing method according to the present invention, the periodic developing irregularities produced during the developing interfere with each other for proper correction.

More specifically, in order to accomplish these and other objects, according to one preferred embodiment of the present invention, there is provided an electrostatic latent image developing method for developing, by a plurality of times, an electrostatic latent image carried on a surface of an electrostatic latent image support member through employment of developing sleeves having magnetic rollers to be driven for rotation provided therein, which includes the steps of effecting the developing for each of the plurality of times, with said magnetic roller being rotated under such a state that developing irregularities in a direction intersecting a relative moving direction of the electrostatic latent image support member with respect to said developing sleeve, are formed in a developed image when the developing for each of the plurality of times is effected independently, causing pitches of the developing irregularities to coincide with each other, and deviating phases of the respective developing irregularities so that said respective developing irregularities are offset to each other thereby to obtain the developed image having a uniform and sufficient image density without developing irregularities.

By the steps of the present invention as described above, an improved electrostatic latent image developing method has been advantageously presented, with substantial elimination of disadvantages inherent in the conventional methods of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
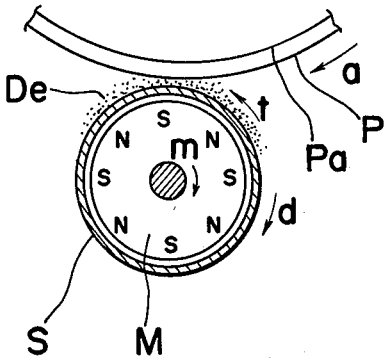
FIG. 1 is a schematic side sectional view showing a general construction of a conventional electrostatic latent image developing apparatus (already referred to)

In the first place, it is to be noted that, according to the present invention, the electrostatic latent image developing method for developing, by a plurality of times, an electrostatic latent image carried on a surface of an electrostatic latent image support member with employment of developing sleeves having magnetic rollers to be driven for rotation provided therein, is effected through the steps of effecting the developing for each of the plurality of times, with said magnetic roller being rotated under such a state that developing irregularities in a direction intersecting a relative moving direction of the electrostatic latent image support member with respect to said developing sleeve, are formed in a developed image when the developing for each of the plurality of times is effected independently, causing pitches of the developing irregularities to coincide with each other, and deviating phases of the respective developing irregularities so that said respective developing irregularities are offset to each other, and thus developed images having a uniform and sufficient image density without developing irregularities are advantageously obtained.

A simple method for causing the pitches of the developing irregularities to coincide as described above is to arrange frequencies of alternating magnetic fields formed at developing regions to be equal to each other during the developing at each time, while a favorable method for deviating the phases thereof is to set the number of developing of the electrostatic latent image at more than $n(n \geqq 2)$ times, with simultaneous deviation of the phases by approximately $2\pi \cdot m/n$, where m represents an integer at a relation of $m:1 \leqq m \leqq n-1$.

For causing the phases to deviate as described above in a simple manner, there may be employed a method for setting a distance L between developing positions (i.e., central positions of the developing regions) at the developing for each time as represented by $$L = w \cdot (N + m/n) \quad (3)$$

where N is an integer.

It should be noted here that, the value of m is not necessarily required to be constant between the respective developing, but that, in the case where the value m is different from one developing to another, these values m should be set in association with each other, to such values enough to counteract the effect of the developing irregularities so that the developing irregularities may ultimately be offset.

Although the value of m/n is represented by $\frac{1}{2}$ when two developing rollers are adopted, if three developing rollers are to be employed, it is possible that there are cases where the value m/n is represented by $\frac{1}{3}$ and $\frac{1}{3}$, and by $\frac{2}{3}$ and $\frac{2}{3}$ so as to deviate phases of the developing irregularities for final offsetting thereof. Even in the above cases, the value N may be varied respectively to suit to the situation.

Alternatively, there may be employed another method in which the distance L referred to above is altered to a distance L' represented by $$L' = w \cdot N \quad (4)$$

while the phases themselves of the alternating magnetic fields are deviated by approximately $2\pi m/n$, where m is the integer at a relation of $1 \leqq m \leqq n-1$.

According to experiments carried out by the present inventor, it has been found that, in the case where the electrostatic latent image developing method according to the present invention is effected, although the number of times for developing the electrostatic latent image (which is the number of times of developing for effecting the electrostatic latent image developing method of the present invention, and represented by n as described earlier) is required to be properly determined by taking into account the size of the pitch for the developing irregularities, since the size of the pitch does not normally become an excessively large value, uniform developed images without developing irregularities may be obtained even when the number of times for developing is two times. Therefore, the embodiments of the electrostatic latent image developing method according to the present invention will be described hereinbelow only with respect to the case where the number of times of developing for the electrostatic latent image is set at two times.

Figure 4:
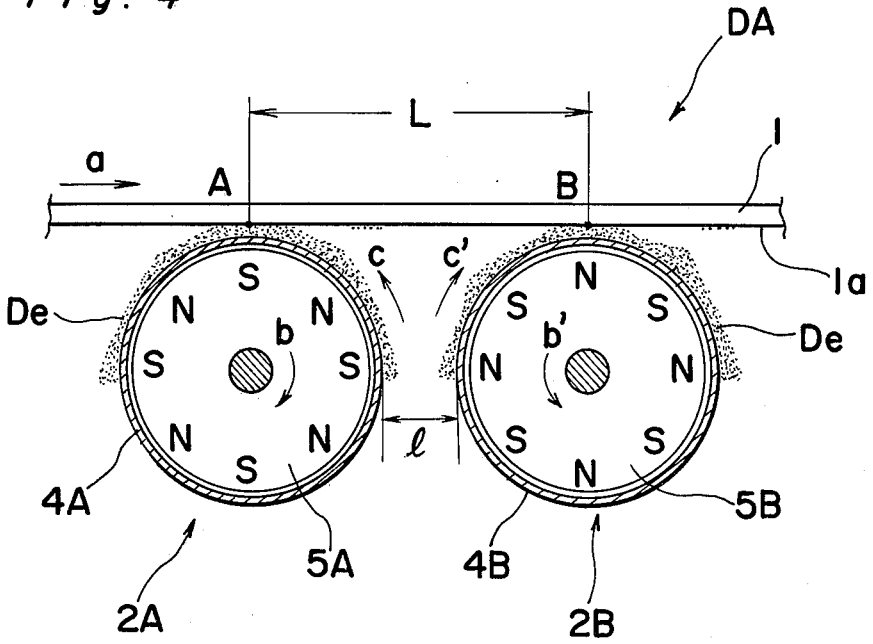
FIG. 4 is a schematic side sectional view showing a main portion of a developing apparatus to be employed for effecting the electrostatic latent image developing method according to the present invention.

Referring now to the drawings, there is shown in FIG. 4, one example of an essential portion of a developing apparatus DA to be used for effecting the electrostatic latent image developing method according to the present invention.

In FIG. 4, the developing apparatus DA includes a first and a second developing rollers 2A and 2B, which are respectively composed of developing sleeves 4A and 4B and magnetic rollers 5A and 5B rotatably provided in said developing sleeves 4A and 4B, and which are disposed below and adjacent to a photoconductive surface 1*a* of a photosensitive member 1, for example, in the form of an endless belt, having an electrostatic latent image formed on the surface 1*a* and arranged to be moved at a constant speed in a direction indicated by an arrow a for developing the electrostatic latent image carried on said photosensitive surface 1*a* by the developing apparatus DA. During developing of the electrostatic latent image, the magnetic roller 5A is driven for rotation in a direction indicated by the arrow b through a driving source (not shown), while the magnetic roller 5B is rotated in the direction of the arrow b' through variation of the magnetic field following the rotation of the magnetic roller 5A due to the fact that the first and second developing rollers 2A and 2B are disposed close to each other through a distance l. Accordingly, the magnetic developing material De supplied onto the peripheral surfaces of the developing sleeves 4A and 4B is to be transported in the directions of the arrows c and c' along said peripheral surfaces during developing of the electrostatic latent image, and is brought into rubbing contact with the surface 1*a* of the photosensitive member 1 at developing regions or more specifically, at regions where said photoconductive surface 1*a* of the photosensitive member 1 and the peripheral surfaces of the developing sleeves 4A and 4B confront each other in proximity so as to develop the electrostatic latent image carried on said surface 1*a* two times. It is to be noted that the developing material De as described above is the so-called dual or two component developing material composed of a mixture of magnetic carrier and electrically insulative toner. It is preferable that the developing sleeves 4A and 4B are also driven for rotation depending on necessity. In the developing apparatus DA of FIG. 4, the developing sleeves 4A and 4B are arranged to be rotated in the same directions as those of the magnetic rollers 5A and 5B (i.e. in the directions indicated by arrows b and b') at rotational speed of 25 r.p.m.

Incidentally, in the developing apparatus DA as described with reference to FIG. 4, points as follows are taken into consideration for effecting the electrostatic latent image developing method according to the present invention. Namely, for coincidence or alignment of pitches of the periodic developing irregularities to be formed during the first and second developing or more specifically, during the developing by each of the first and second developing rollers 2A and 2B, the number of magnetic poles for each of the magnetic rollers 5A and 5B is arranged to be eight poles, with the revolutions thereof being set at 900 r.p.m. so as to make the frequencies of alternating magnetic fields formed at the developing regions to be equal to each other. Such frequency is 120 Hz in the above case. In addition, in order to deviate the phases of the both developing irregularities by $\pi$, it is so arranged that a distance L between the developing positions in the first and second developing or more specifically, between first and second developing positions A and B satisfies the equation (3) referred to earlier, based on the simple method as described previously. Here, upon substitution of specific values into the equation (3) based on the developing apparatus as described so far with reference to the equations (1) and (2) earlier described, the equation (3) is represented as $$L=2.5\cdot(N+\tfrac{1}{2}) \qquad (3)'$$

In the developing apparatus described so far, owing to the limitation that each of the developing sleeves 4A and 4B has a diameter of 31 mm, and that the developing rollers 2A and 2B must be disposed close to each other so as to allow rotation of the magnetic roller 5B following driving of the magnetic roller 5A, the integer N is set to be 14, with the distance L being set to 36.25 mm. By the above settings, the phases of the developing irregularities of the both are deviated by $\pi$ because the phases of the alternating magnetic fields formed at the first and second developing positions A and B are perfectly aligned with each other due to the fact that the magnetic roller 5B is rotated following rotation of the magnetic roller 5A.

Subsequently, the electrostatic latent image developing method according to the present invention to be effected through employment of the developing apparatus DA of FIG. 4 will be described hereinbelow.

Figure 2:
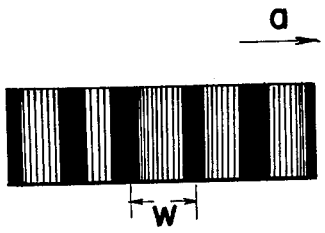
FIG. 2 is a diagram showing the state of generation of a periodic developing irregularities (already referred to)
Figure 3:
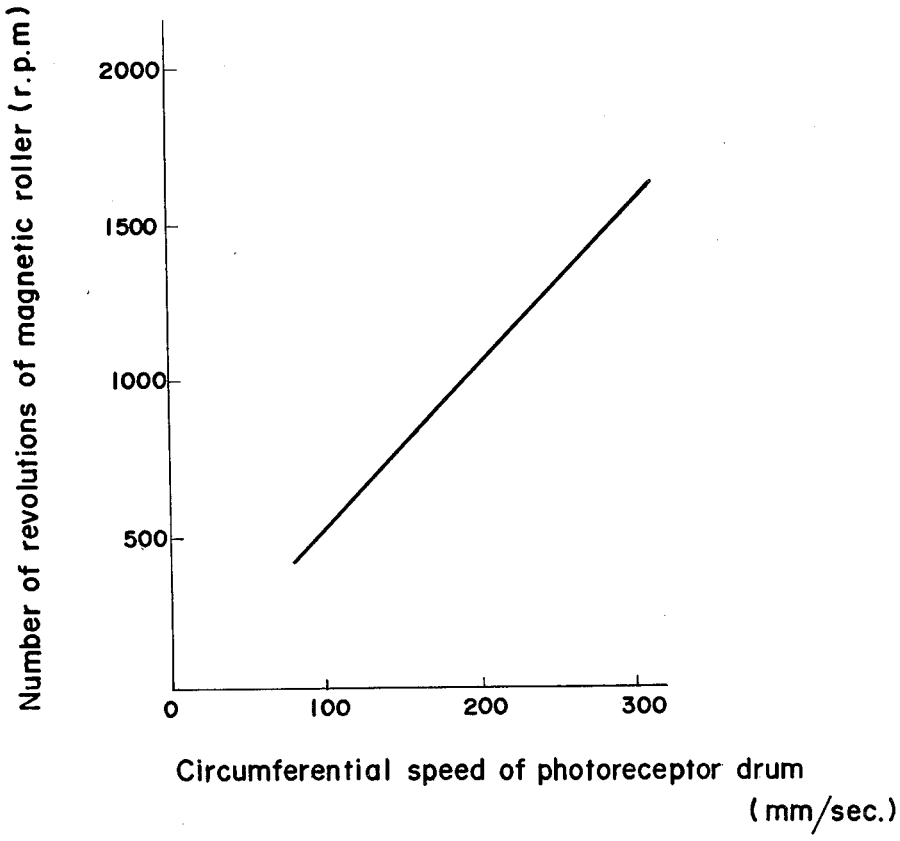
FIG. 3 is a graph explanatory of conditions for generation of the developing irregularities.

In the first place, the photoconductive surface 1*a* of the photosensitive member 1 passes through the first developing position A as the photosensitive member 1 is moved in the direction of the arrow a, and in the above case, the electrostatic latent image carried on the surface 1*a* is subjected to the first developing by the first developing roller 2A. During the above developing, since the number of revolutions of the magnetic roller 5A is set to be a comparatively small value at 900 r.p.m. with respect to the moving speed of the surface 1*a* of the photosensitive member 1 set at 300 mm/sec., the periodic developing irregularities as shown in FIG. 2 are produced in the developed image, with the pitch of such developing irregularities being at 2.5 mm specifically, which coincides with the value as obtained by the equation (2) referred to earlier.

Successively, when the surface 1*a* of the photosensitive member 1 passes through the developing position B, the electrostatic latent image carried on said surface 1*a* is subjected to the second developing by the second developing roller 2B. Although developing irregularities with the pitch of 2.5 mm are produced during this second developing in the similar manner as in the first developing, such developing irregularities in the second developing interfere with those in the first developing so as to be offset each other in said second developing. More specifically, since the distance L is set at 36.25 mm in a state where the phases of the alternating magnetic fields formed at the first and second developing positions A and B are in agreement with each other, both of the developing irregularities are to be represented in a relation where they are overlapped through deviation at $\frac{1}{2}$ of the pitch thereof, i.e. through positional deviation by 1.25 mm, thus resulting in the offset function as stated earlier.

Figure 5:
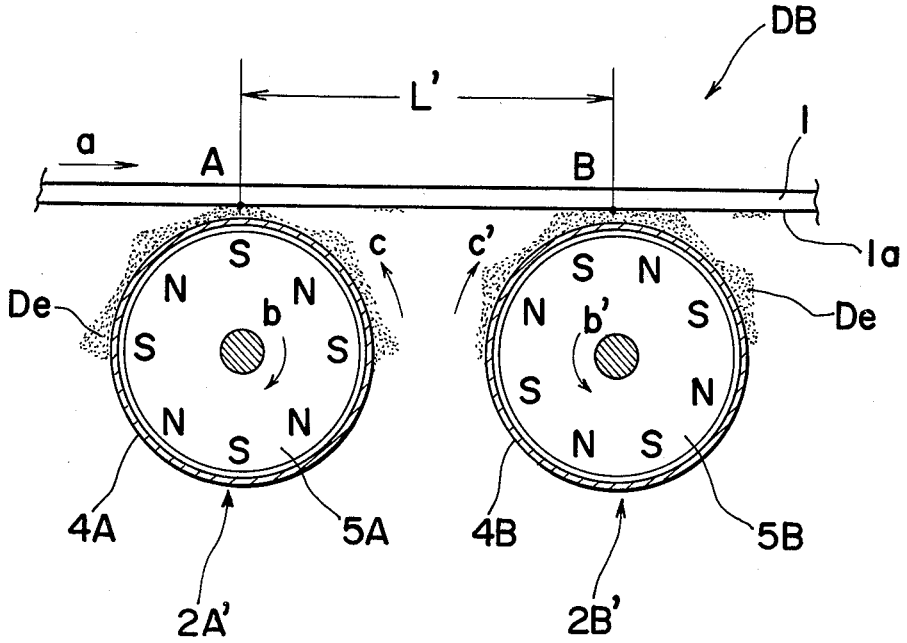
FIG. 5 is a view similar to FIG. 4, which particularly shows a modification thereof.

Referring to FIG. 5, another example of the developing apparatus which may be used for effecting the electrostatic latent image developing method according to the present invention will be described hereinbelow.

Since overall construction of the developing apparatus DB of FIG. 5 is generally similar to that of the developing apparatus DA of FIG. 4, like parts are designated by like reference numerals for brevity of description.

It is to be noted here that the difference between the developing apparatus DA of FIG. 4 and the developing apparatus DB of FIG. 5 resides in the method of deviating the phases of the developing irregularities to be produced during the first and second developing, and that, in the developing apparatus DB, a method different from that as described earlier with reference to the developing apparatus DA in FIG. 4 is employed for setting the distance L′ between the first and second developing positions A and B and for deviating the phases of the alternating magnetic fields.

More specifically, in the developing apparatus DB of FIG. 5, the distance L′ is set to satisfy the equation (4) described earlier. When specific values are substituted into the equation (4) based on the developing apparatus DB with reference to the equations (1) and (2), the above equation (4) will be represented as $$L'=2.5\cdot N \qquad (4)'$$

In the developing apparatus DB of FIG. 5, since the magnetic rollers 5A and 5B are arranged to be coupled for being driven by gears and the like (not shown), it is not particularly necessary to dispose the developing rollers 2A′ and 2B′ close to each other, and therefore, only the diameter of the developing sleeves 4A and 4B is taken into account, with the distance L′ set at 45 mm, and the value N set at 18.

Moreover, the phases of the alternating magnetic fields to be formed at the first and second developing positions A and B are deviated by $\pi$ so that, when the magnetic pole of the magnetic roller 5A confronts the first developing position A, the portion between the magnetic poles of the magnetic roller 5B faces the second developing position B without fail. In other words, the magnetic rollers 5A and 5B are coupled to each other in such a manner that the magnetic roller 5B is driven for rotation in a state where it is displaced in the rotational direction thereof by $\pi/8$ at all times with respect to the magnetic roller 5A. Since other functions of the developing apparatus DB of FIG. 5 are exactly the same as those of the developing apparatus DA of FIG. 4, detailed description thereof is abbreviated here for brevity.

It should noted here that, although the electrostatic latent image developing method according to the present invention may be specifically effected in the manner as described in the foregoing, for the actual application thereof, it is also possible to employ the so-called monocomponent magnetic developing material composed only of magnetic toner. It is also to be noted that, the present invention may be effected, with AC developing bias being applied to the developing sleeve, but in this case, the state of formation of the developing irregularities is slightly different from that in the above case, and the developing irregularities do not take place so as to satisfy the equation (2) described earlier, and therefore, it is necessary to effect the developing after taking into consideration, the pitch of the developing irregularities which are actually formed.

As is seen from the foregoing description, in the electrostatic latent image developing method according to the present invention, in spite of reduction of the rotational driving speed of the magnetic roller down to such a low level as will produce developing irregularities, the developing irregularities resulting therefrom are advantageously rectified through the plurality of times of developing and thus, uniform developed images without developing irregularities may be obtained. Accordingly, by the electrostatic latent image developing method of the present invention, the degree of occurrence of various inconveniences taking place following the high speed rotational driving of the magnetic roller may be sufficiently reduced, while the developing method of the present invention can fully cope with the developing of electrostatic latent images supported on the surfaces of electrostatic latent image support members to be moved at high speeds.

Figure 6:
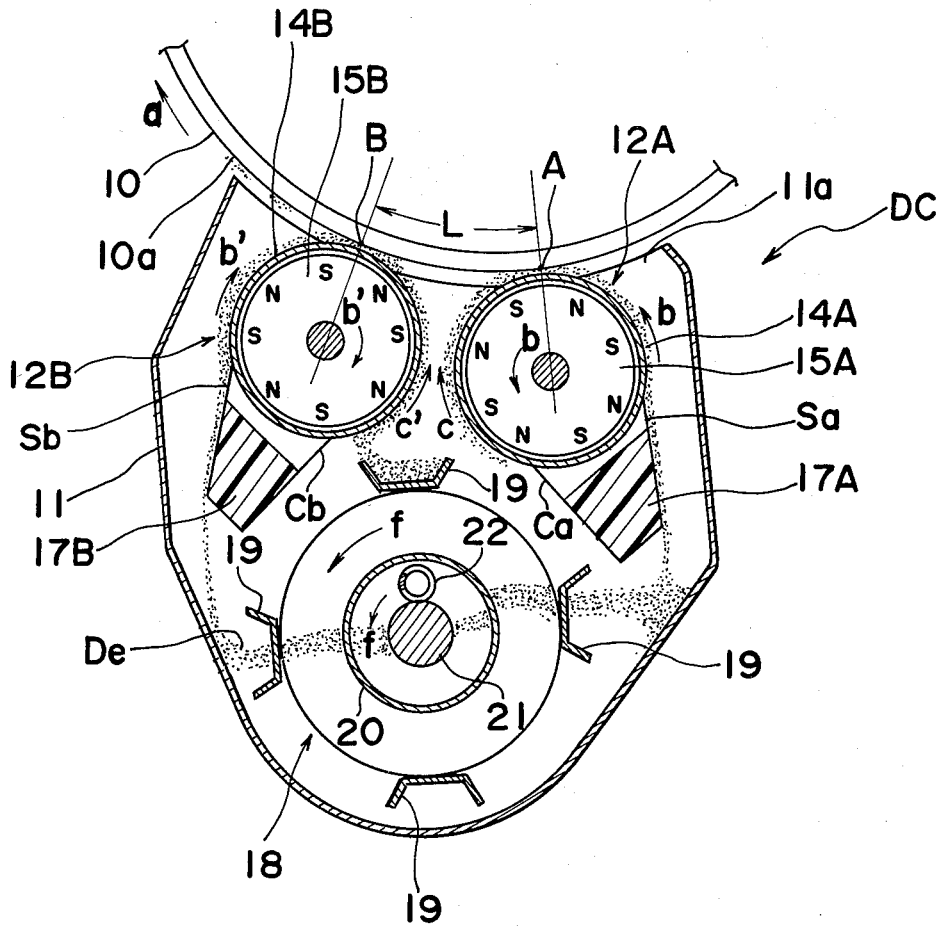
FIG. 6 is a side sectional view of a developing apparatus to which the arrangement of FIG. 4 is specifically applied for effecting the electrostatic latent image developing method according to the present invention.

Referring further to FIG. 6, there is shown an electrostatic latent image developing apparatus DC for effecting the electrostatic latent image developing method according to the present invention as actually applied to an electrographic copying apparatus, based on the principle explained so far with reference to the developing apparatus DA of FIG. 4.

It should be noted here that, the developing material employed in the developing apparatus DC to be described hereinbelow is the same developing material as that employed in the arrangement of FIGS. 4 or 5.

In the arrangement of FIG. 6, there are provided:

(1) a first developing roller 12A which includes a developing sleeve 14A of non-magnetic material, and a magnetic roller 15A sequentially magnetized, at its peripheral portion, with N and S poles in the circumferential direction thereof and coaxially mounted in said developing sleeve 14A so as to be driven for rotation, and (2) a second developing sleeve 12B which includes a developing sleeve 14B of similar non-magnetic material, and a magnetic roller 15B sequentially magnetized, at its peripheral portion, with N and S poles in the circumferential direction thereof and coaxially mounted in said developing sleeve 14B so as to be rotated by the force of rotating magnetic field following rotation of said magnetic roller 15A, (3) while a first developing position A and a second developing position B on the surface 10*a* of an electrostatic latent image support member 10 in the form of a photoreceptor drum 10 to be developed by said first and second developing rollers 12A and 12B are spaced from each other by a distance L along the surface 10*a* of the electrostatic latent image support member 10 in the moving direction thereof, and the distance L is represented by the equation as follows.

$$L = \frac{Vpc}{Nmg \cdot Rmg/60}(N + \tfrac{1}{2}) \qquad (5)$$

where

Vpc: moving speed of the surface of the electrostatic latent image support member 10(mm/sec.)

Nmg: number of poles of the first magnetic roller 15A,

Rmg: number of revolutions of the first magnetic roller 15A (r.p.m.), and

N: integer

More specifically, in FIG. 6, the developing apparatus DC is disposed adjacent to the photoconductive surface 10*a* of the electrostatic latent image support member, i.e. photoreceptor drum 10 which is driven for rotation at a circumferential speed, for example, at 300 mm/sec. in the direction indicated by the arrow a so that the electrostatic latent image preliminarily formed on the photoconductive surface 10*a* in a known manner is developed into a visible toner image when it passes through the developing apparatus DC.

The developing apparatus DC to be employed for effecting the electrostatic latent image developing method according to the present invention generally includes a housing or developing tank 11 extending the width of the photoreceptor drum 10 and substantially enclosed except for an opening 11*a* adjacent to the photoreceptor surface 10*a* of said photoreceptor drum 10 whereat the development of electrostatic latent images formed on the surface 10*a* is effected, the first and second developing rollers 12A and 12B respectively having the developing sleeves 14A and 14B and the magnetic rollers 15A and 15B as described above, and a developing material stirring device or bucket roller 18 rotatably provided at the lower portion within the developing tank 11 in a position below the developing rollers 12A and 12B.

The developing sleeves 14A and 14B for the developing rollers 12A and 12B are each made of a cylinder of non-magnetic material and more specifically, stainless steel material with a diameter of 31 mm, and confront the photoconductive surface 10*a* of the photoreceptor drum 10 through a developing gap of 0.7 mm so as to be driven for rotation by a rotating drive source (not shown) at revolutions of 25 r.p.m. in the directions indicated by the arrows b and b′ respectively. The magnetic rollers 15A and 15B coaxially incorporated in the respective developing sleeves 14A and 14B are each magnetized, at the peripheral portion thereof, successively with eight N and S poles in the circumferential direction thereof, and have a flux density of 1000 G on the surface of the developing sleeves 14A and 14B. The magnetic roller 15A is arranged to be driven for rotation by a rotating drive source (not shown) at revolutions of 900 r.p.m. in the direction of the arrow b, while the other magnetic roller 15B is adapted to rotate in the direction of the arrow b′ by the force of the rotating magnetic field (i.e. magnetic field variations) following rotation of the magnetic roller 15A, owing to the disposition of the first and second developing rollers 12A and 12B in positions close to each other. It is to be noted here that the number of magnetic poles for the respective magnetic rollers 15A and 15B need not necessarily be in agreement with each other, but such magnetic poles should preferably be in even number larger than four poles.

Scraper members Sa and Sb each made of a phosphor bronze plate of 50 μm thick and sleeve clearner plates Ca and Cb each formed of a thin stainless steel plate of 100 μm thick are respectively mounted on holders 17A and 17B made of resin material so as to contact, at forward edges thereof, the peripheral surfaces of the developing sleeves 14A and 14B in directions following and against the rotating directions of the respective developing sleeves 14a and 14b as shown.

Meanwhile, the bucket roller 18 provided with a plurality of buckets or troughs 19 arranged on the peripheral surface thereof is installed within the developing tank 11 in the position below the first and second developing rollers 12A and 12B for rotation about an axis parallel with axes of the developing rollers 12A and 12B in a direction indicated by an arrow f. At the central portion of the bucket roller 18, there is secured a toner transport pipe 20, in which a rotary shaft 21 having a toner transport spring 22 in a coil shape spirally wound therearound is provided so as to be driven for rotation in the direction of the arrow f.

It should be noted here that the magnetic developing material De to be used for the developing apparatus DC of FIG. 6 is the same developing material as that in the arrangement of FIGS. 4 or 5 described earlier, and is the so-called two or dual component developing material composed of a mixture of electrically insulative toner having an average particle diameter of 11 μm and high resistance magnetic carrier having an average particle diameter of 21 μm and resistance value of $10^{14}$ Ωcm.

By the above arrangement, the magnetic developing material De supplied onto the peripheral surfaces of the developing sleeves 14A and 14B by the bucket roller 18 is respectively transported along said peripheral surfaces of said developing sleeves 14A and 14B in the directions of the arrows c and c′ at a speed corresponding to a difference between the transporting force in the direction of the arrows c and c′ resulting from rotation of the magnetic rollers 15A and 15B in the directions of the arrows b and b′, and the transporting force in the directions of the arrows b and b′ resulting from rotation of the developing sleeves 14A and 14B in the directions of the arrows b and b′. During the above transportation, the magnetic developing material De rubs against the photoconductive surface 10a of the photoreceptor drum 10 rotating in the direction of the arrow a at the first developing position A and the second developing position B whereat the developing sleeves 14A and 14B respectively confront the photoconductive surface 10a in a close relation therewith so as to develop the electrostatic latent image supported on said surface 10a two times.

The first developing position A and second developing position B are spaced from each other by a distance L along the surface 10a of the photoreceptor drum 10 in the direction of movement thereof, with the distance L being set so as to satisfy the equation (5) referred to earlier. More specifically, the equation (5) is one derived to deviate by $\pi$, the phases of the pitches w (FIG. 2) of the periodic developing irregularities to be produced during the developing by each of the first and second developing rollers 12A and 12B, and Nmg.Rmg/60 represents the frequency Fmg of the alternating magnetic field formed at the respective developing positions A and B by the magnetic rollers 15A and 15B (equation (1)), while $$\frac{Vpc}{Nmg \cdot Rmg/60}$$

denotes the pitches w of the developing irregularities (equation (2)).

Accordingly, the equation (5) described earlier may be represented as $$L = \frac{Vpc}{Fmg}(N + \tfrac{1}{2}) \qquad (5)'$$

or $$L = w(N + \tfrac{1}{2}) \qquad (5)''$$

It should be noted here that, in the developing apparatus as described so far, the frequencies Fmg of the alternating magnetic field formed at the first and second developing positions A and B are respectively 120 Hz based on the equation (1), while the pitches w of the developing irregularities are respectively 2.5 mm as obtained from the equation (2).

Incidentally, on the basis of the equation (5), the distance L will be 36.25 mm, when the integer N is set to be 14 by taking into consideration, such restrictions that the diameter of each of the developing sleeves 14A and 14B is 31 mm, and that the developing rollers 12A and 12B must be disposed close to each other so as to enable the magnetic roller 15B to rotate following the rotation of the magnetic roller 15A. Of course, the reason why the phases of the developing irregularities at the first and second developing positions A and B are deviated by $\pi$ due to setting of the distance L in the above described manner is that the phases of the alternating magnetic fields formed at the first and second developing positions A and B are perfectly in alignment with each other owing to the arrangement in which the magnetic roller 15B is rotated following the rotation of the magnetic roller 15A.

Subsequently, the developing phenomenon at the first and second developing positions A and B will be explained hereinbelow.

Firstly, in the first developing at the first developing position A, since the revolutions of the magnetic roller 15A are set to be a comparatively small value at 900 r.p.m., while the circumferential speed of the photoreceptor drum 10 is at 300 mm/sec., the periodic developing irregularities as shown in FIG. 2 are produced in the developed images. More specifically, the pitch of said developing irregularities is 2.5 mm, which is in agreement with the value obtainable by the equation (2).

The above developed image is successively subjected to the second developing at the second developing position B. Although developing irregularities at the pitch of 2.5 mm are also formed during the above second developing in the similar manner as in the first developing, such developing irregularities at the second developing act to offset the developing irregularities at the first developing through mutual interference therebetween at said second developing. In other words, since the distance L is set at 36.25 mm in the state where the phases of alternating magnetic fields formed at the first and second developing positions A and B are in alignment, both of the developing irregularities are represented, in the final developed image, as overlapped each other through deviation by ½ of the pitches, i.e. by 1.25 mm, thus presenting the offset effect as described earlier.

As is seen from the foregoing description, when the electrostatic latent image developing method according to the present invention is effected by the developing apparatus DC as shown in FIG. 6, uniform developed images without any developing irregularities may be obtained, and as a result of various investigations made by the present inventor into the developing apparatus as described so far for the confirmation of effects available from the electrostatic latent image developing method according to the present invention, following points have been clarified.

(1) With respect to the developing apparatus as described above, although favorable developed images uniform in quality without developing irregularities may be achieved, with revolutions of the magnetic rollers 15A and 15B at 900 r.p.m., in order to obtain such developed images by only one developing roller, it was necessary to drive the magnetic rollers for rotation at revolutions as high as 2200 r.p.m.

(2) Eddy currents produced in the developing sleeves, and in electrically conductive materials in the vicinity of the developing sleeves during driving of the magnetic roller at revolutions as high as 2200 r.p.m. as described above are approximately three times the eddy currents produced in those portions of the developing apparatus as described so far, thus giving rise to excessive heat generation by the developing sleeves, etc.

(3) The driving energy required for driving the magnetic roller at revolutions of 2200 r.p.m. was slightly over two times that for driving the magnetic roller 15A of the developing apparatus described so far.

It should be noted here that, even in the case where the developing of the electrostatic latent image at two times is effected through employment of the two developing rollers 12A and 12B, with the phases of developing irregularities being deviated by $\pi$, if the pitch of the developing irregularities formed by the developing of one time is increased, i.e. when the revolutions Rmg of the magnetic rollers 15A and 15B are reduced, developing irregularities still become conspicuous actually in spite of the developing effected two times. In other words, there is a substantial lower limit to the value of revolutions Rmg of the magnetic rollers 15A and 15B, and it is necessary to set the value of the revolutions Rmg so that the developing irregularities become inconspicuous. However, according to the experiments carried out by the present inventor, it has been found that, since the value for the pitch w of the developing irregularities does not become excessively large in normal cases, uniform developed images without developing irregularities may be obtained when the developing is effected two times as in the embodiment described so far.

It should also be noted here that, particularly with respect to the developing material composed of a mixture of electrically insulative toner having average particle diameter of 5 to 20 $\mu$m and high resistance magnetic carrier prepared by dispersing magnetic fine particles into the resin so as to have average particle diameter of 15 to 60 $\mu$m and resistance value of $10^{12}$ $\frac{1}{3}$cm, there has been a tendency that the density of the developed images is proportionally reduced as the revolutions of the magnetic rollers are lowered, with a consequent lowering of the density of developed image obtained at each developing. However, it has been ensured by the present inventor that, by effecting the developing two times as in the embodiment described so far, increase of density of the developed images may be simultaneously achieved in addition to the offset of the developing irregularities.

It is to be further noted that the present invention is not limited in its application to the embodiment as described so far, but may be modified in various ways within the scope. For example, the arrangement of the present invention may be modified in such a manner that the first developing is effected by the second developing roller in which the second magnetic roller is rotated following rotation of the first magnetic roller, while the second developing is effected by the first developing roller in which the first magnetic roller is driven for rotation.

Figure 7:
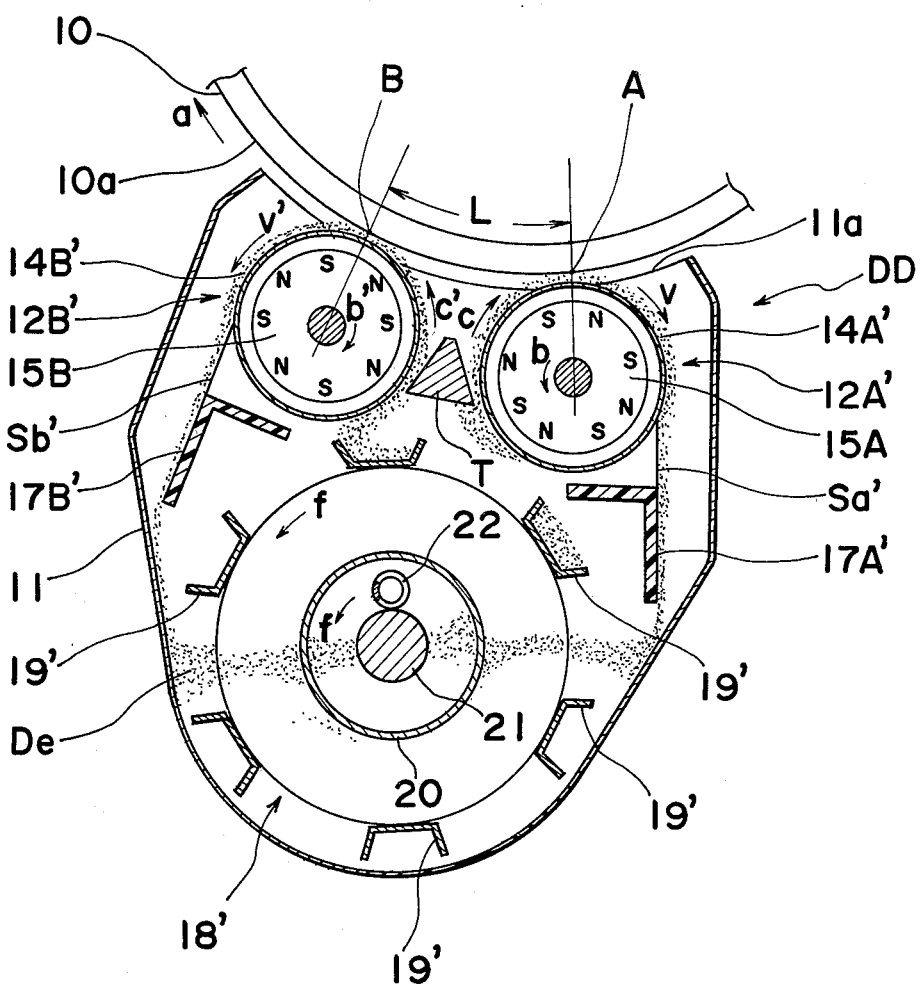
FIG. 7 is a view similar to FIG. 6, which particularly shows another modification thereof.

Referring further to FIG. 7, there is shown a modification of the developing apparatus DC of FIG. 6 for effecting the electrostatic latent image developing method according to the present invention.

In the modified developing apparatus DD of FIG. 7, the developing sleeves 14A and 14B described as rotated in the directions b and b′ (i.e. in the same directions as the magnetic rollers 15A and 15B) at revolutions of 25 r.p.m. are replaced by the developing sleeves 14A′ and 14B′ which are driven for rotation at revolutions of 75 r.p.m. in directions indicated by arrows v and v′ (i.e. in the directions opposite to the rotational directions b and b′ of the magnetic rollers 15A and 15B), while the scrapers Sa and Sb and sleeve clearner plates Ca and Cb mounted on the holders 17A and 17B in the arrangement of FIG. 6 are also replaced by scrapers Sa′ and Sb′ each mounted on the holders 17A′ and 17B′ of resin material, and made, for example, of a stainless steel plate of 100 $\mu$m thick arranged to contact, at forward edges thereof, with the peripheral surfaces of the developing sleeves 14A′ and 14B′ in directions against the rotational directions v and v′ of said developing sleeves 14A′ and 14B′. Moreover, in a position between the developing rollers 12A′ and 12B′, there is disposed a bristle height regulating member T having a triangular cross section, with a clearance of 0.7 mm being maintained with respect to the peripheral surface of each of the developing sleeves 14A′ and 14B′. The clearance should preferably be a value of $\pm$0.2 mm with respect to the developing gap, and in this modification, the clearance is made equal to the developing gap. Furthermore, the bucket roller 18′ is provided with an increased number of buckets, for example, six buckets 19′ as compared with the four buckets 19 in the arrangement of FIG. 6 and is driven for rotation at a higher speed; for example, at 75 r.p.m. in the direction as indicated by the arrow f, whereby the supplying amount of the developing material is increased as compared with the arrangement in FIG. 6. The developing material to be employed for the developing apparatus DD is composed of a mixture of electrically insulative toner having an average particle diameter of 11 $\mu$m and high resistance magnetic carrier having an average particle diameter of 45 $\mu$m and resistance value of $10^{14}$ $\Omega$cm.

Since other constructions and effects of the modified developing apparatus DD of FIG. 7 including the positional relation of the developing rollers, etc. are generally similar to those of the developing apparatus DC of FIG. 6, detailed description thereof is abbreviated for brevity.

As is clear from the foregoing description, in the electrostatic latent image developing method according to the present invention, notwithstanding the fact that the rotational speed of the magnetic roller is reduced to such an extent that the developing irregularities are formed, such developing irregularities resulting therefrom may be corrected following the developing by the plurality of times, and thus, uniform developed images without any developing irregularity can be advantageously obtained. Such being the case, according to the electrostatic latent image developing method of the present invention, the degree of occurrence of various inconveniences taking place following the high speed driving of the magnetic roller in the conventional developing methods may be sufficiently suppressed, while the developing method of the present invention can fully cope with the developing of electrostatic latent images carried on the surface of an electrostatic latent image support member moving at high speeds.

Furthermore, even in the case where electrostatic latent images are to be developed through employment of the developing material proposed by the present inventor as described earlier, developed images at a sufficient image density may be obtained without requiring high speed driving of the magnetic roller.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrostatic latent image developing method for developing, by a plurality of times, an electrostatic latent image carried on a surface of an electrostatic latent image support member through employment of developing sleeves having magnetic rollers to be driven for rotation provided therein, which comprises the steps of effecting the developing for each of the plurality of times, with said magnetic roller being rotated under such a state that developing irregularities in a direction intersecting a relative moving direction of the electrostatic latent image support member with respect to said developing sleeve, are formed in a developed image when the developing for each of the plurality of times is effected independently, causing pitches of the developing irregularities to coincide with each other, and deviating phases of the respective developing irregularities so that said respective developing irregularities are offset to each other, thereby to obtain the developed image having a uniform and sufficient image density without developing irregularities.

2. An electrostatic latent image developing method as claimed in claim 1, wherein the plurality of times for developing the electrostatic latent image is set to be more than $n(n \geqq 2)$ times, with said phases of the respective developing irregularities being deviated by approximately $2\pi \cdot m/n$, wherein m is an integer of $1 \leqq m \leqq n-1$.

3. An electrostatic latent image developing method as claimed in claim 2, wherein the developing for each of the plurality of times is effected, with frequencies of alternating magnetic fields formed in developing regions being arranged to be equal to each other.

4. An electrostatic latent image developing method as claimed in claim 2, wherein m is set to be one.

5. An electrostatic latent image developing method as claimed in claim 3, wherein the developing for each of the plurality of times is effected through employment of a dual component magnetic developing material composed of a mixture of electrically insulative toner having average particle diameter of 5 to 20 μm and high resistance magnetic carrier having average particle diameter of 15 to 60 μm and resistance value higher than $10^{12}$ Ωcm, as the developing material.

6. An electrostatic latent image developing method as claimed in claim 5, wherein the magnetic carrier in said developing material is prepared by dispersing magnetic fine particles in resin.

7. An electrostatic latent image developing method as claimed in claim 3, wherein the developing of the electrostatic latent image by more than n times is effected through employment of a developing apparatus in which said developing sleeves are provided by more than n pieces along the relative moving direction of said electrostatic latent image support member, with a distance L between central positions of the developing regions corresponding to the respective developing sleeves in said relative moving direction of said electrostatic latent image support member being represented by $$L = \frac{Vpc}{Fmg} \cdot (N + m/n)$$

where Vpc is the relative moving speed (mm/sec.) of the surface of the electrostatic latent image support member with respect to the developing apparatus, Fmg is the frequency (Hz) of the alternating magnetic field formed at the respective developing regions, and N is an arbitrary integer.

8. An electrostatic latent image developing method as claimed in claim 7, wherein relations are represented by $n=2$ and $m=1$.

9. An electrostatic latent image developing method as claimed in claim 8, wherein each of the magnetic rollers provided in said developing apparatus is composed of a roller having N and S poles sequentially magnetized, in even number, at a peripheral portion thereof through alternately different polar orientation, so that only the magnetic roller at one side is driven for rotation, with the other magnetic rollers being magnetically rotated by the action of the alternating magnetic field produced following driving of said magnetic roller at one side for rotation.

10. An electrostatic latent image developing method as claimed in claim 9, wherein the developing for each of the plurality of times is effected through employment of a dual component magnetic developing material composed of a mixture of electrically insulative toner having average particle diameter of 5 to 20 μm and high resistance magnetic carrier having average particle diameter of 15 to 60 μm and resistance value higher than $10^{12}$ Ωcm, as the developing material.

11. An electrostatic latent image developing method as claimed in claim 9, wherein the magnetic carrier in said developing material is prepared by dispersing magnetic fine particles in resin.

* * * * *